US006605050B2

(12) United States Patent
Hansen

(10) Patent No.: US 6,605,050 B2
(45) **Date of Patent: *Aug. 12, 2003**

(54) BODY PULSATING JACKET

(75) Inventor: Craig N. Hansen, Minnetonka, MN (US)

(73) Assignee: Electromed, Inc., New Prague, MN (US)

( * ) Notice: Subject to any disclaimer, the term of this patent is extended or adjusted under 35 U.S.C. 154(b) by 8 days.

This patent is subject to a terminal disclaimer.

(21) Appl. No.: 09/875,213

(22) Filed: Jun. 7, 2001

(65) Prior Publication Data

US 2002/0042938 A1 Apr. 18, 2002

Related U.S. Application Data

(62) Division of application No. 09/267,593, filed on Mar. 12, 1999, now Pat. No. 6,254,556.
(60) Provisional application No. 60/077,707, filed on Mar. 12, 1998.

(51) Int. Cl.[7] ..... A61H 31/00
(52) U.S. Cl. ..... 601/41; 601/44
(58) Field of Search ..... 601/148–152, 601/41, 44; 128/DIG. 20; 600/207; 602/13; 606/192; 36/29

(56) References Cited

U.S. PATENT DOCUMENTS

| | | | |
|---|---|---|---|
| 2,223,570 | A | 12/1940 | McMillin |
| 2,354,397 | A | 7/1944 | Miller |
| 2,588,192 | A | 3/1952 | Akerman et al. |
| 2,762,366 | A | 9/1956 | Huxley, III et al. |
| 2,780,222 | A | 2/1957 | Polzin et al. |
| 2,869,537 | A | 1/1959 | Chu |
| 2,899,955 | A | 8/1959 | Huxley, III et al. |
| 3,043,292 | A | 7/1962 | Mendelson |
| 3,063,444 | A | 11/1962 | Jobst |
| 3,078,842 | A | 2/1963 | Gray |

(List continued on next page.)

FOREIGN PATENT DOCUMENTS

| | | |
|---|---|---|
| CA | 1225889 | 8/1987 |

OTHER PUBLICATIONS

"Chronic bronchial asthma and emphysema," Geriatrics, Jun. 1966.
Enhanced Tracheal Mucus Clearance with High Frequency Chest Wall Compression, American Review of Respiratory Disease, Sep. 1983.
"Peripheral mucociliary clearance with high–frequency chst wall compression," Journal of Applied Physiology, Apr. 1985.
"Artificial Ventilation," 1986.
"Tracheal mucus clearance in high–frequency oscillation: effect of peak flow rate bias," The European Respiratory Journa, Jan. 1990.
"High–frequency Chest Compression System to Aid in Clearance of Mucus from the Lung," Biomedical Instrumentation & Technology, Jul. 1990.
"Preliminary Evaluation of High–Frequency Chest Compression for Secretion Clearance in Mechanically Ventilated Patients," Respiratory Care, Oct. 1993.

*Primary Examiner*—Danton D. DeMille

(57) ABSTRACT

A jacket for a human body has an air core coupled to a pulsator operable to subject the jacket to air pressure pulses which applies and releases pressure to the human body. The jacket has a cover having a pocket accommodating the air core. The pulsator has diaphragms connected to a d.c. electric motor with a rotary to reciprocating motion transmitting mechanism operable to generate air pressure pulses which are transmitted to the air core which applies repetitive pressure pulses to the human body.

11 Claims, 9 Drawing Sheets

U.S. PATENT DOCUMENTS 3,179,106 A 4/1965 Meredith
3,310,050 A 3/1967 Goldfarb
3,545,017 A 12/1970 Cohn
3,577,977 A 5/1971 Ritzinger, Jr. et al.
4,120,297 A 10/1978 Rabischong et al.
4,135,503 A 1/1979 Romano
4,178,922 A 12/1979 Curlee
4,186,732 A 2/1980 Christoffel
4,590,925 A 5/1986 Dillon
4,621,621 A 11/1986 Marsalis
4,637,074 A * 1/1987 Taheri ..... 2/DIG. 3
4,676,232 A 6/1987 Olsson et al.
4,682,588 A 7/1987 Curlee
4,838,263 A 6/1989 Warwick et al.
4,840,167 A 6/1989 Olsson et al.
4,952,095 A 8/1990 Walters
4,977,889 A 12/1990 Budd
5,007,412 A 4/1991 DeWall
5,056,505 A 10/1991 Warwick et al.
5,222,478 A 6/1993 Scarberry et al.
5,235,967 A 8/1993 Arbisi et al.
5,370,603 A 12/1994 Newman
5,453,081 A 9/1995 Hansen
5,494,469 A * 2/1996 Heath et al. ..... 441/118
5,569,170 A 10/1996 Hansen
D379,396 S 5/1997 Rongo et al.
5,769,800 A 6/1998 Gelfand et al.
6,036,662 A 3/2000 Van Brunt et al.
6,155,996 A 12/2000 Van Brunt et al.

* cited by examiner

AIR
PULSATOR

BODY PULSATING JACKET

CROSS REFERENCE TO RELATED APPLICATION

This application is a division of U.S. application Ser. No. 09/267,593 filed Mar. 12, 1999 now U.S. Pat. No. 6,254,556. Application Ser. No. 09/267,593 claims the priority benefit of U.S. Provisional Application Serial No. 60/077,707 filed Mar. 12, 1998.

FIELD OF THE INVENTION

The invention is directed to a medical device used to apply repetitive compression forces to the body of a person to aid blood circulation, loosening and elimination of mucus from the lungs of a person and relieve muscular and nerve tensions.

BACKGROUND OF THE INVENTION

Artificial respiration devices for applying and relieving pressure on the chest of a person have been used to assist in lung breathing functions, and loosening and eliminating mucus from the lungs. Subjecting the person's chest and lungs to pressure pulses or vibrations decreases the viscosity of lung and air passage mucus, thereby enhancing fluid mobility and removal from the lungs. These devices use vests having air-accommodating bladders that surround the chests of persons. Mechanical mechanisms, such as solenoid or motor-operated air valves, supply air under pressure to the bladders in regular patterns of pulses. J. D. Ackerman et al in U.S. Pat. No. 2,588,192 disclose an artificial respiration apparatus having a chest vest supplied with air under pressure with an air pump. Solenoid-operated valves control the flow of air into and out of the vest in a controlled manner to pulsate the vest, thereby subjecting the person's chest to repeated pressure pulses. W. J. Warwick and L. G. Hansen in U.S. Pat. No. 5,056,505 disclose a chest compression apparatus having a chest vest surrounding a person's chest. A motor-driven rotary valve allows air to flow into the vest and vent air therefrom to apply pressurized pulses to the person's chest.

R. S. Dillion in U.S. Pat. No. 4,590,925 uses an inflatable enclosure to cover a portion of a person's extremity, such as an arm or leg. The enclosure is connected to a fluid control and pulse monitor operable to selectively apply and remove pressure on the person's extremity. R. L. Weber in U.S. Pat. No. 3,672,354 discloses a rest inducing device having an air mattress supplied with air in pulses from an air pump at the frequency of the person's heartbeat.

C. N. Hansen in U.S. Pat. Nos. 5,453,081 and 5,569,170 discloses an air pulsating apparatus for supplying pulses of air to an enclosed receiver, such as a vest or an air mattress. The apparatus has a casing with an internal chamber containing a diaphragm. A solenoid connected to the diaphragm is operated with a pulse generator to move the diaphragm to pulse the air in the chamber. A hose connects the chamber with the vest to transfer the air pulses to the vest. This apparatus requires a sizeable solenoid which is relatively heavy and uses considerable electrical power. The solenoid generates heat and noise. The body pulsating apparatus of the present invention overcomes the weight, noise and heat disadvantages of the prior air pulsating apparatus.

SUMMARY OF THE INVENTION

The invention comprises a jacket used to apply repetitive pressure pulses to a human body and a pulsator for generating air pressure pulses that are transmitted to the jacket. The jacket has an outer cover attached to a flexible liner. An air core of flexible material located between the cover and liner is connected with a hose to a pulsator operable to generate repetitive air pressure pulses which are transmitted to the air core. The air pressure pulses subjected to the air core create repetitive pressure pulses that are transmitted to the body of a person wearing the jacket. The pulsator has a casing with an internal chamber in air communication with the hose. A diaphragm open to the internal chamber is connected to a motion transmitting mechanism which moves the diaphragm relative to the internal chamber to sequentially increase and decrease the pressure of the air in the internal chamber thereby generating air pressure pulses. An electric motor drives the motion transmitting mechanism which moves the diaphragm. A motor control regulates the speed of the motor to control the air pressure pulse rate.

The preferred embodiment of the pulsator has a casing with an internal chamber with first and second diaphragms. A check valve, such as a reed valve or flapper valve, mounted on the casing allow air to flow into the chamber responsive to movements of the diaphragms. A motion transmitting mechanism driven with an electric motor has a pair of cams and cam followers connected to the diaphragms operable to reciprocate the diaphragms thereby generating air pressure pulses in the internal chamber. The air pressure pulses are transferred to the air core of the vest which applies repetitive pressure pulses to the body of the person. A motor control regulates the speed of the motor to control the air pressure pulse rate.

DESCRIPTION OF PREFERRED EMBODIMENT

Figures 1, 1A, 2:
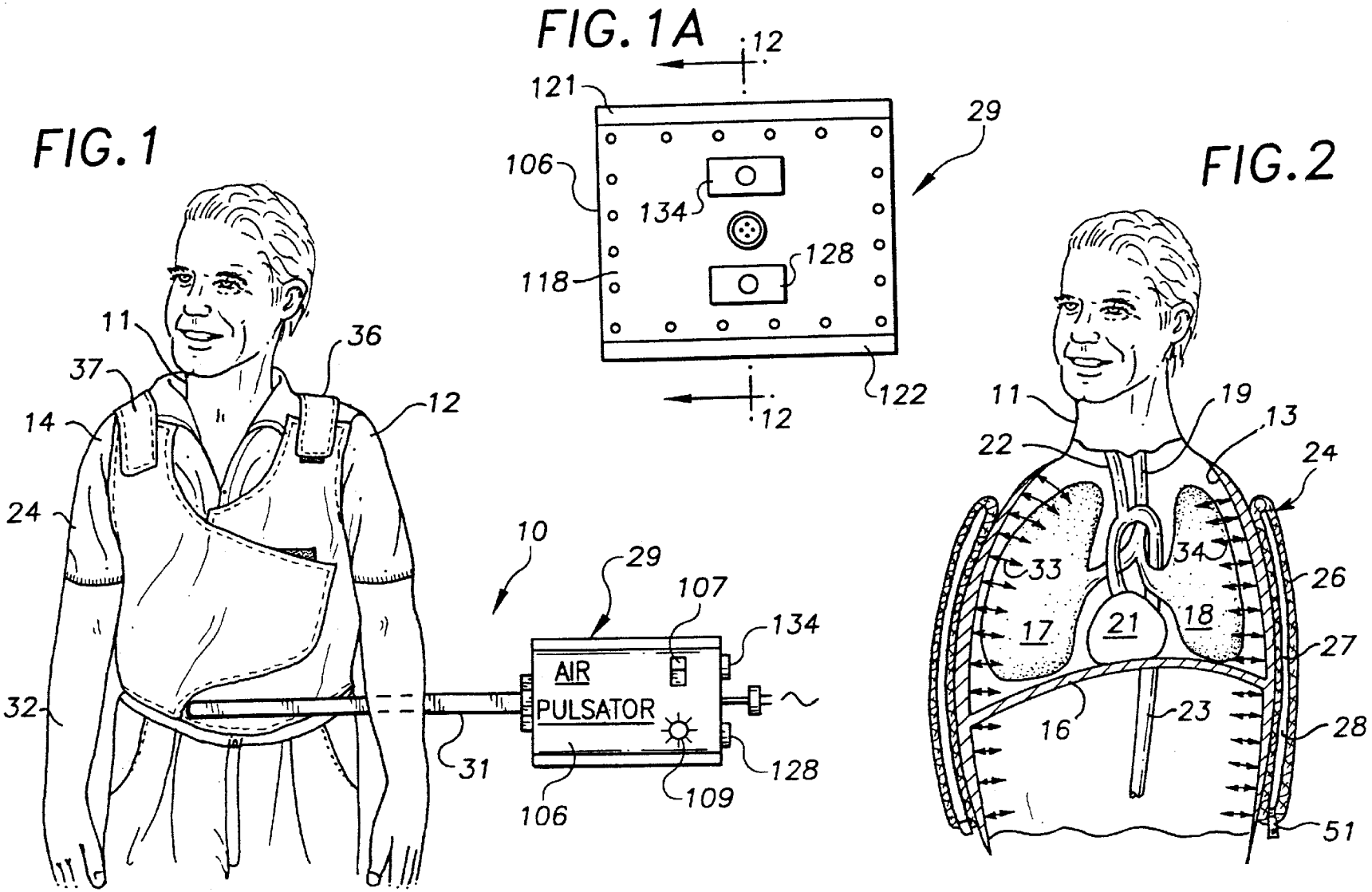
FIG. 1 is a diagrammatic view of the body pulsating apparatus located on a body of a person.
FIG. 1A is an enlarged end view of the right end of the air pulsator of FIG. 1.
FIG. 2 is a diagrammatic view, partly sectioned, of the jacket of the body pulsating apparatus of FIG. 1.

The body pulsating apparatus 10, shown in FIG. 1, functions to apply repetitive pressure pulses to a person 11 having an upper body 13 and left and right shoulders 12 and 14. A diaphragm 16 extends across the body below lungs 17 and 18.

A jacket 24 located about body 13 has an outside cover 26 joined to an inside liner 27. Cover 26 is a non-elastic fabric. Liner 27 is an open mesh flexible sheet member secured to outer peripheral edges of cover 26. Fasteners, shown as stitches 25 in FIG. 6, connect liner 27 to cover 26 and a bottom zipper 51. An air core 28 confined between cover 26 and liner 27 operates to apply repeated fluid, herein air, pressure pulses, shown as arrows 33 and 34, to body 11. The frequency of the pulses is variable. The pressure of the air varies between 0.25 psi to 1 psi. Air core 28 can be subjected to other air pressures.

An air pulsator 29 connected to jacket 24 with air hose 31 delivers air under pressure to air core 28. Hose 31 is connected to a tube 32 attached to jacket 24. The end of hose 31 telescopes over tube 32 to releasably connect hose 31 to jacket 24. The air pressure delivered to air core 28 periodically increases and decreases to apply pressure pulses to body 13. The details of pulsator 29 are hereinafter described.

Figure 3:
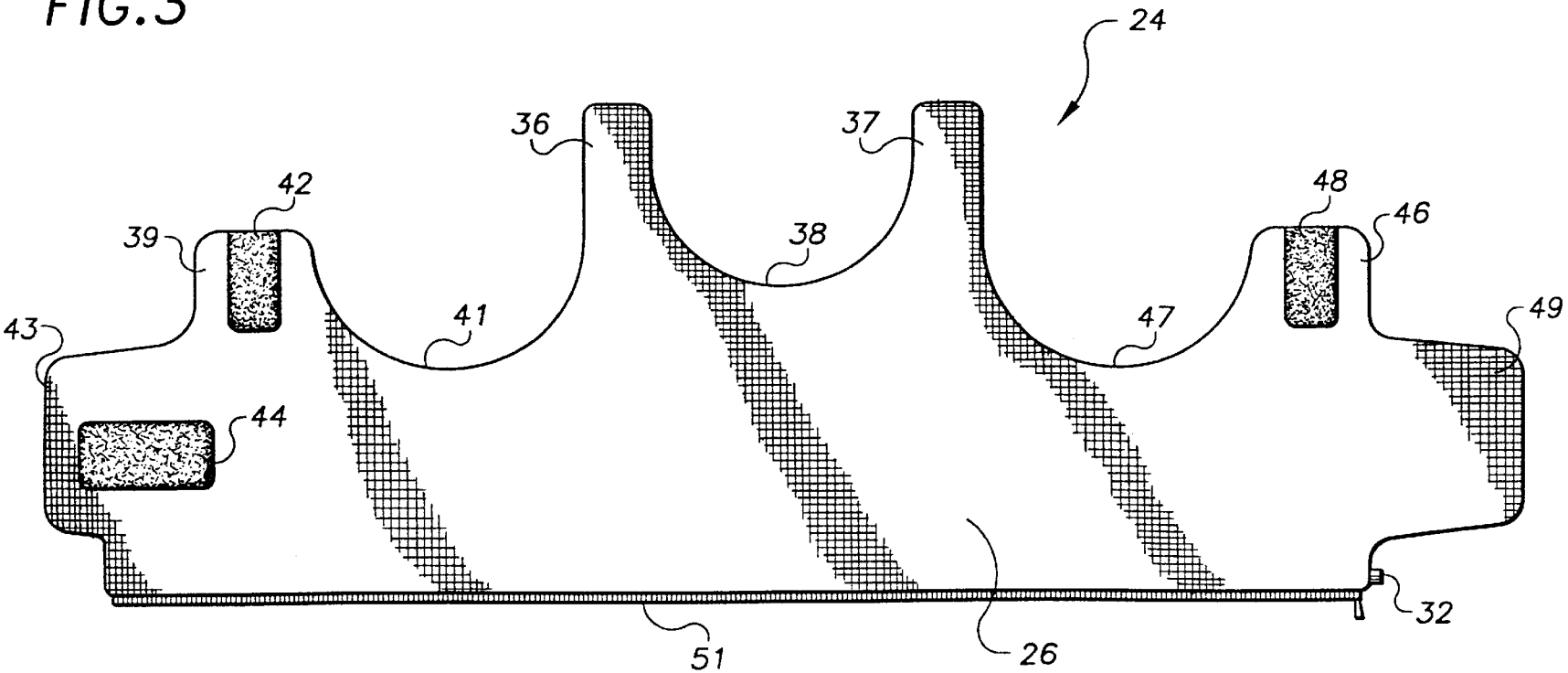
FIG. 3 is an outside plan view of the jacket of FIG. 2.
Figure 4:
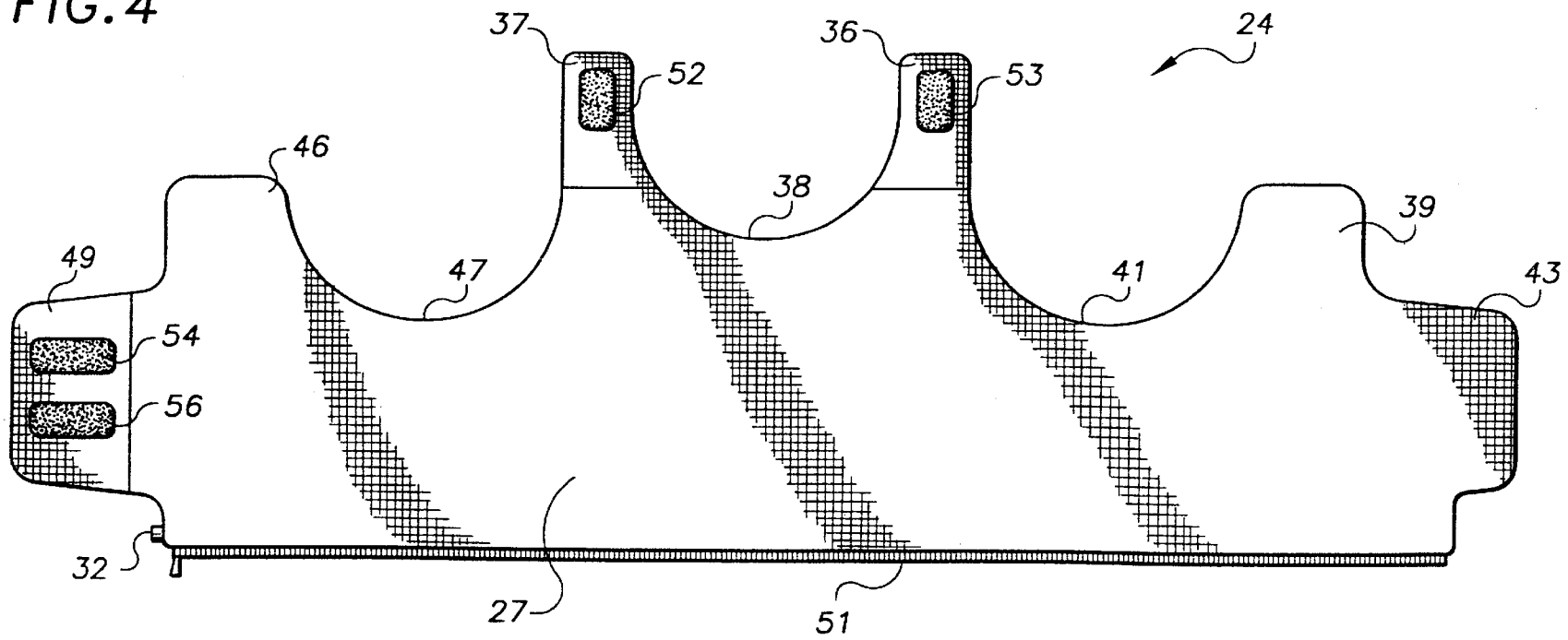
FIG. 4 is an inside plan view of the jacket of FIG. 3.
Figure 5:
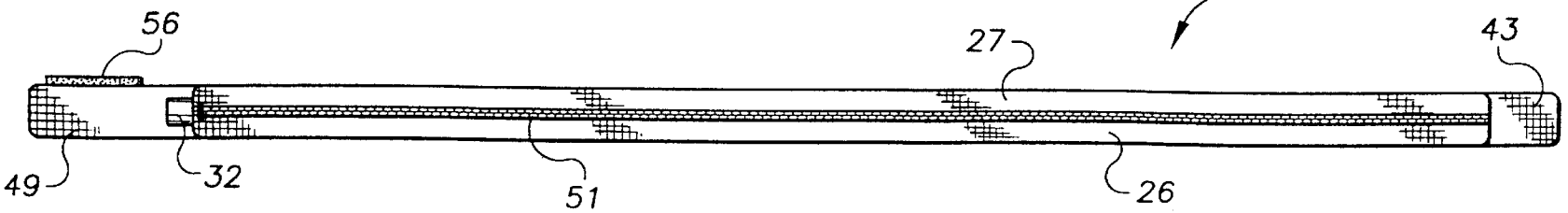
FIG. 5 is a bottom view of the jacket of FIG. 4.

As shown in FIG. 3, jacket 24 has a pair of upright shoulder straps 36 and 37 laterally separated with a concave upper back edge 38. Upright front chest portions 39 and 46 are separated from straps 36 and 37 with concave curved upper edges 41 and 47 which allow jacket 24 to fit under the person's arms. Loop pads 42 and 48 secured to the outer surfaces of chest portions 39 and 46 cooperate with hook pads 52 and 53 secured to the insides of shoulder straps 36 and 37 to releasably connect shoulder straps 36 and 37 to chest portions 39 and 46. As shown in FIG. 1, shoulder straps 36 and 37 extend forwardly over shoulders 12 and 14 and downwardly over chest portions 39 and 46. The hook and loop pads 42, 48, 52 and 53 are releasable VELCRO fasteners that connect shoulder straps 36 and 37 to chest portions 39 and 46 and hold chest portions 39 and 46 adjacent the front of body 13.

Jacket 24 has a first lateral end flap 43 extended outwardly at the left side of jacket 24. A rectangular loop pad 44 secured to the outside of flap 43 cooperates with hook pads 54 and 56 on a second lateral end flap 49 on the right side of jacket 24 to hold jacket 24 around body 13. The hook and loop pads 44, 54 and 56 are VELCRO fasteners that allow jacket 24 to be tightly wrapped around body 13.

Figure 6:
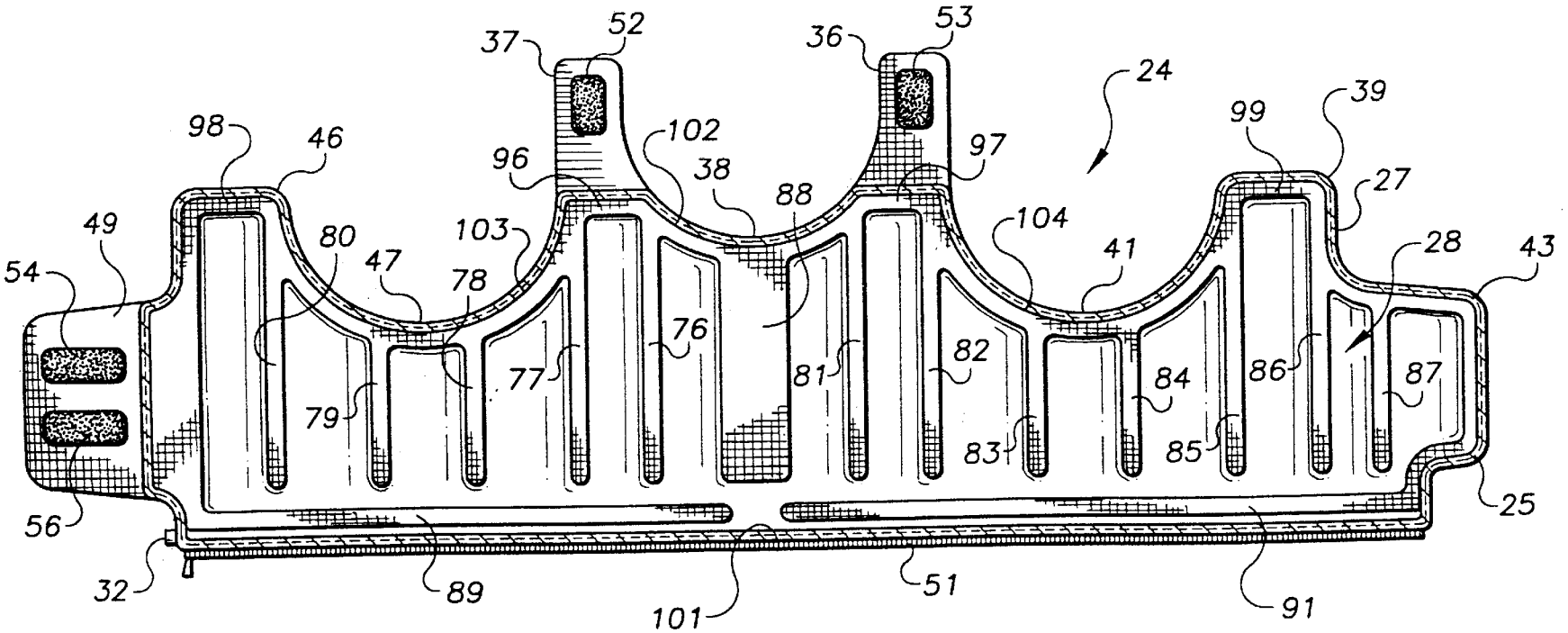
FIG. 6 is a plan view of the inside of the jacket, partly sectioned, showing the air core.
Figure 7:
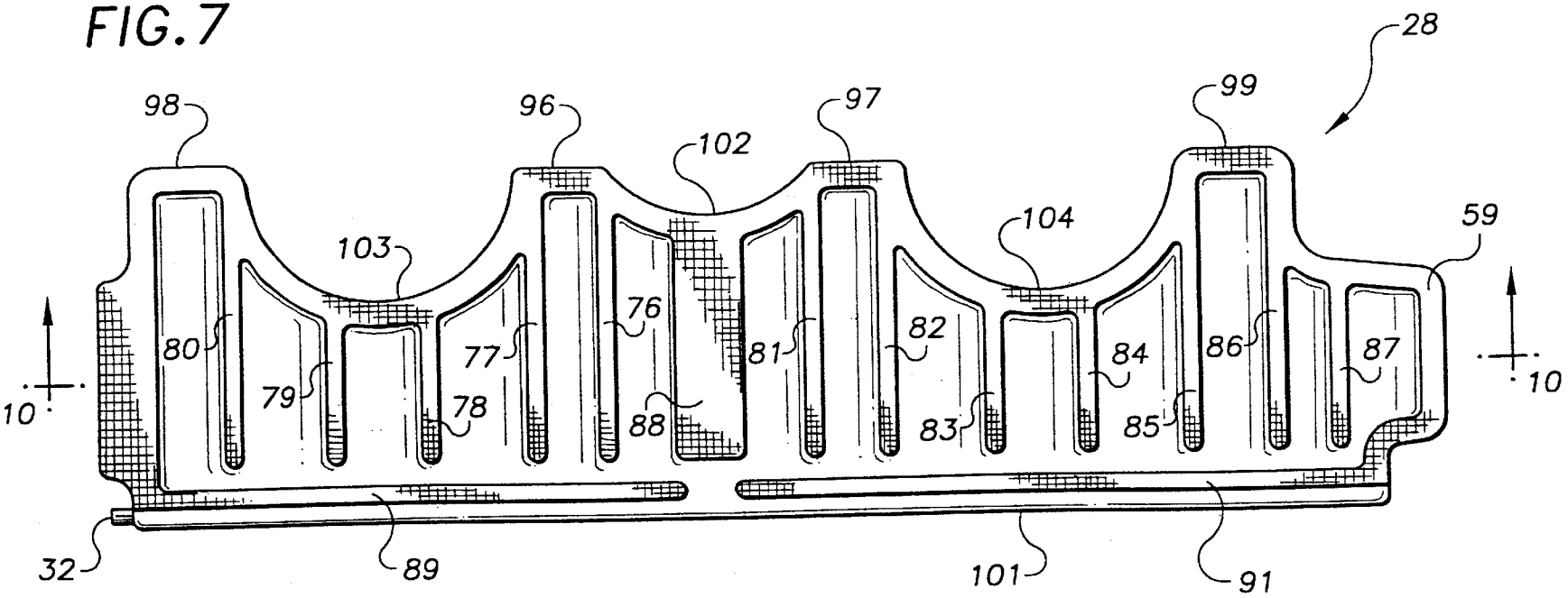
FIG. 7 is a plan view of the air core of the body pulsating apparatus.
Figure 8:
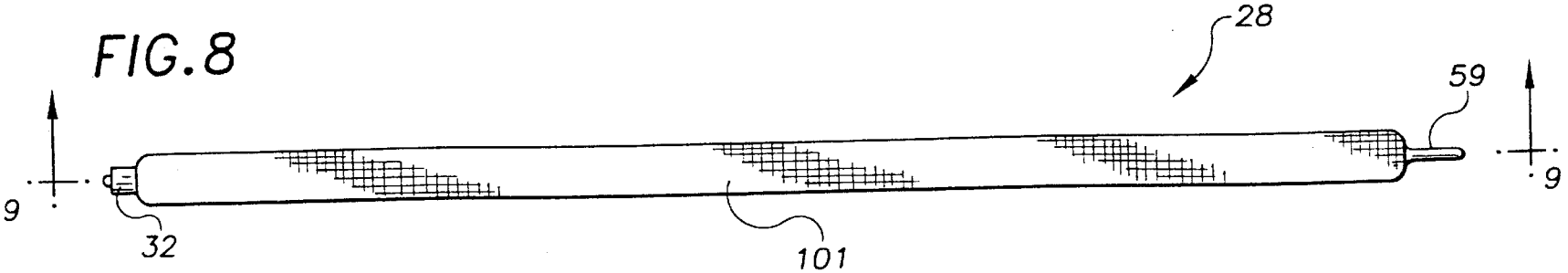
FIG. 8 is a bottom view of the air core of FIG. 7.

Air core 28, shown in FIG. 6, conforms to the shape and contour of the space between cover 26 and liner 27. As shown in FIGS. 7 and 8, air core 28 has a pair of upright back sections 96 and 97 that fit into pockets in shoulder straps 36 and 37 and upright front sections 98 and 99 that fit into chest portions 39 and 46. The bottom section 101 of air core 24 is linear and has a length about the length of zipper 51. Air core 28 has air impervious plastic sheet members 57 and 58 having outer peripheral edges 59 and vertical strips 76 to 87 heat sealed together forming enclosed vertical air chambers 61 to 74, shown in FIGS. 9 and 10. Horizontal strips 89 and 91 are heat sealed together generally parallel to the bottom edge 101. The bottom ends of vertical strips 76 to 87 are spaced about horizontal strips 89 and 91 providing an air feeder passage 94 open to the bottom ends of air chambers 61 to 74. The middle sections 88 of sheet member 57 and 58 are sealed together between back air chambers 61 and 67. Strips 89 and 91 have adjacent ends spaced from each other providing a port or opening 92 between a manifold passage 93 and air feed passage 94 to allow air to flow into and out of air chambers 61 to 74. The bottom of middle section 88 spaced about port 92 directs air into air feeder passage 94.

Figure 12:
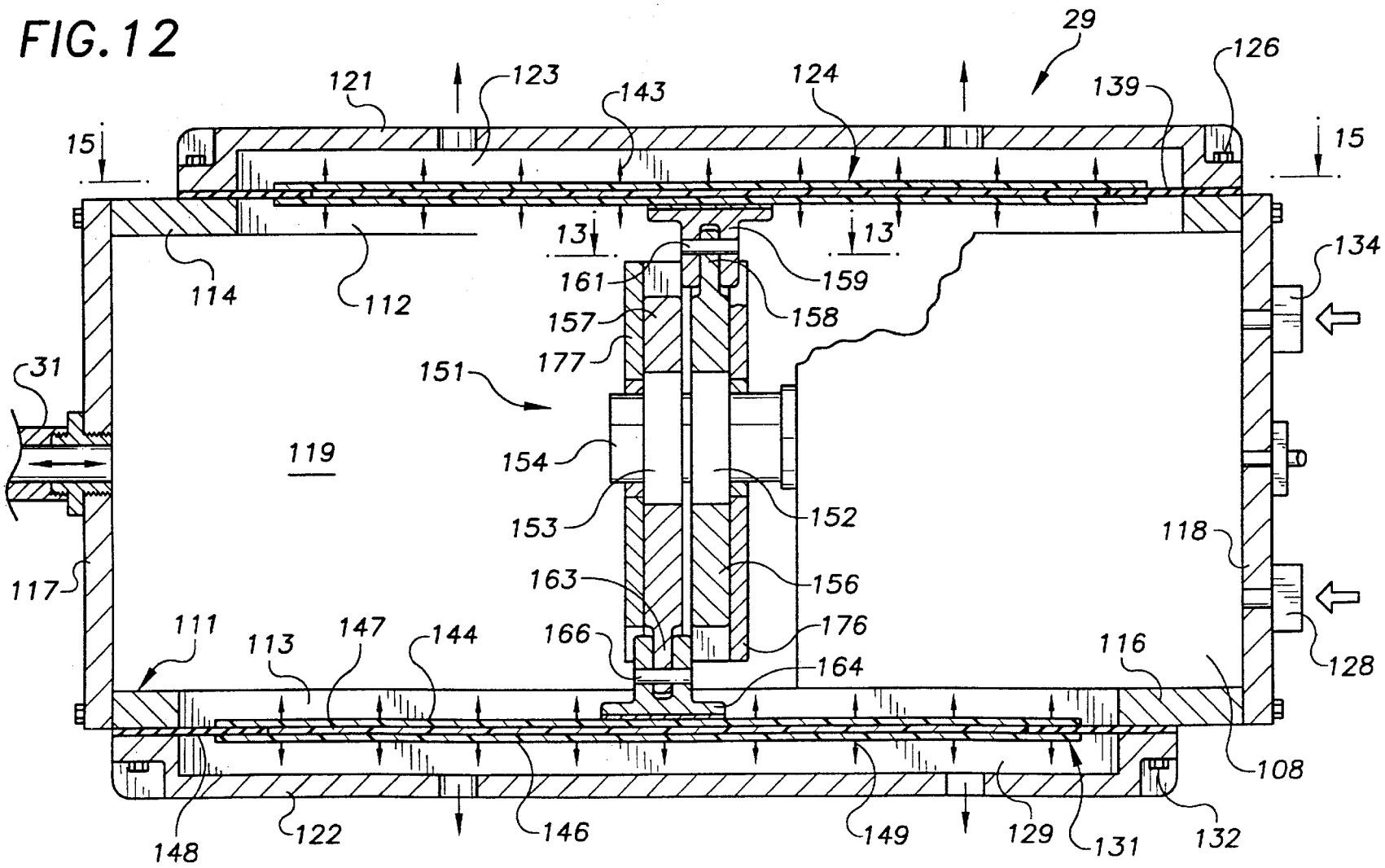
FIG. 12 is an enlarged sectional view of the air pulsator taken along line 12—12 of FIG. 1.

As shown in FIGS. 1 and 12, air pulsator 29 has a box shaped case 106 supporting an ON-OFF switch 107 for controlling the operation of a d.c. electric motor 108. An adjustable control 109, shown as a dial in FIG. 1, functions to control the operating speed of motor 108 which regulates the pulse cycles or frequency of the pulses. For example, control 109 is adjustable to regulate the air pulses between 3 to 15 air pulses per second.

Pulsator 29 has a square tubular body 111 with openings 112 and 113 in opposite walls 114 and 116. End plates 117 and 118 connected to opposite ends of body 111 close chamber 119 in body 111 and confine motor 108 to chamber 119. Plates 117 and 118 can be provided with openings to allow air to flow through chamber 119 and motor 108. Openings 112 and 113 are covered with head plates 121 and 122. Head plate 121 has a generally rectangular chamber 123. A generally square diaphragm 124 extended across chamber 123 is clamped to wall 114 with bolts 126. A variable orifice proportional free-flow valve 128 is connected to end plate 118 to vary the pressure of air in pulsator 29 and jacket 24. Air hose 31 is connected to end plate 117. Hose 31 transmits air pulses from pulsator 29 to jacket 24. The pressure of the air in pulsator 29 and jacket 24 is between 0.25 psi and 1 psi. Other air pressures can be used.

Head plate 122 has a generally rectangular chamber 129 closed with a generally rectangular diaphragm 131. Bolts 132 clamp head plate 122 and diaphragm 131 to wall 116. A one-way valve 134 mounted on end plate 118 allows air to be drawn into pumping chamber 119 upon operation of pulsator 29 to inflate the air core 28 in jacket 24. Valve 134 is a reed-type or flapper-type check valve that allows air to flow into pumping chamber 119 in response to reciprocating movements of diaphragms 124 and 131 and automatically close when the flow of the air attempts to reverse direction. When the air pressure in pumping chamber 119 falls below atmospheric pressure, valve 134 allows additional air to be drawn into pumping chamber 119. An air pump (not shown) coupled to air hose 31 can be used to supply air under pressure to jacket 24 and pulsator 29 to initially inflate apparatus 10.

Figure 15:
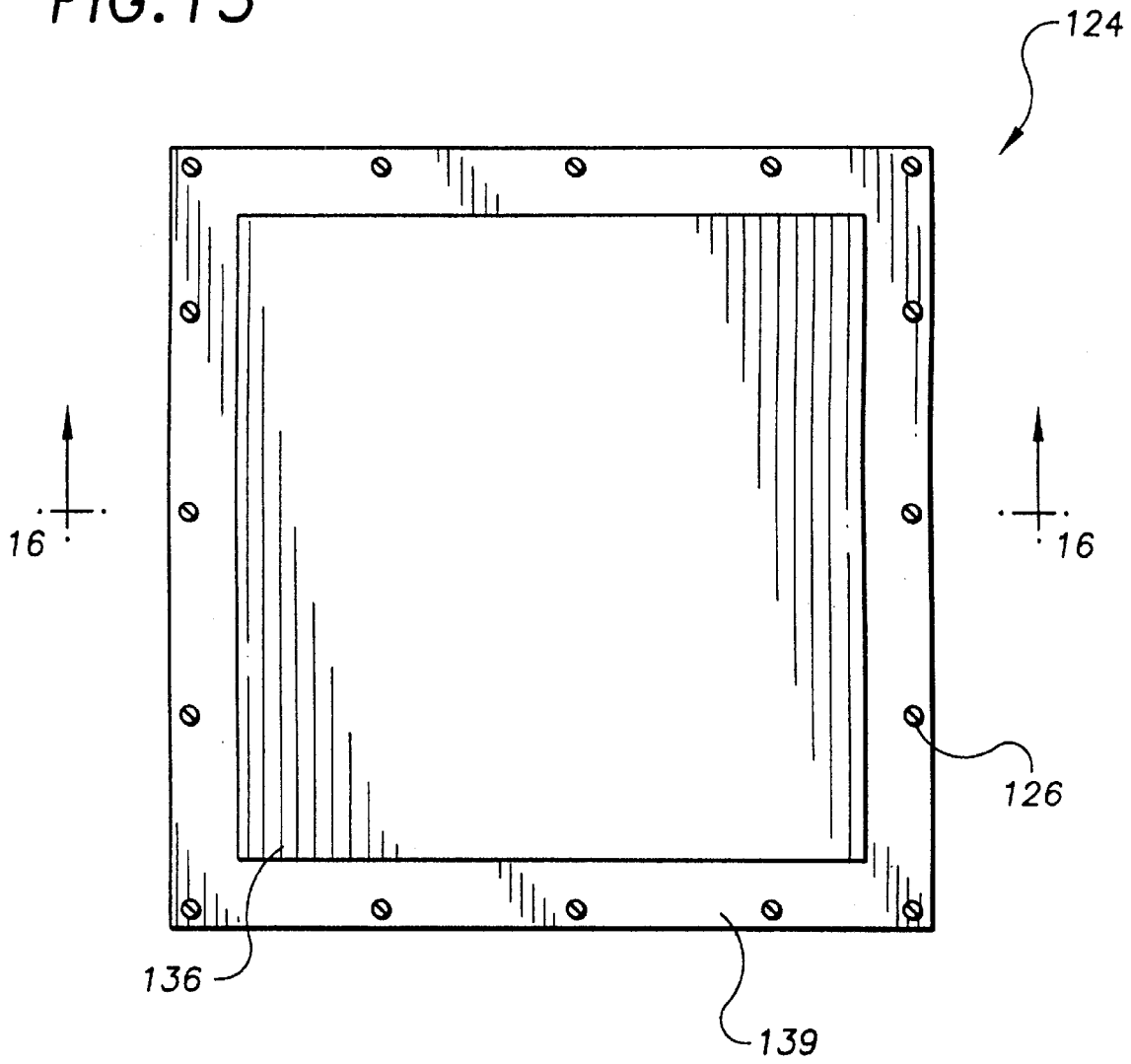
FIG. 15 is a reduced sectional view taken along the line 15—15 of FIG. 12.
Figure 16:
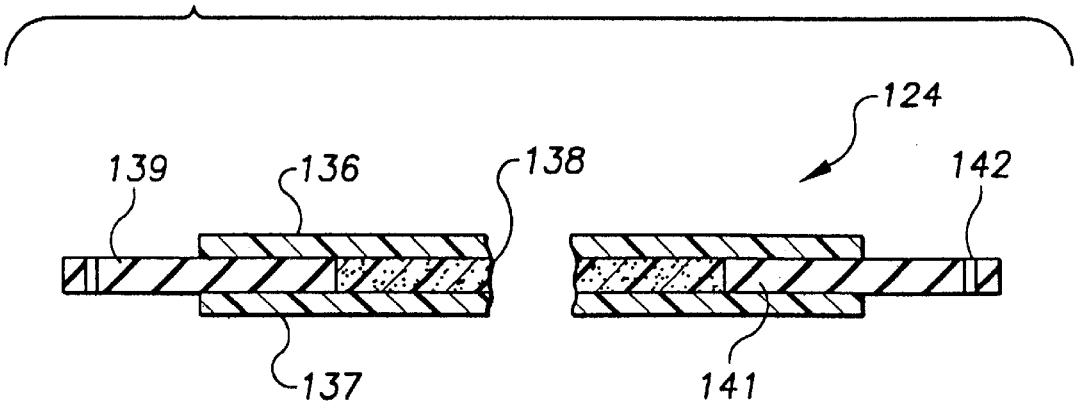
FIG. 16 is a foreshortened sectional view taken along the line 16—16 of FIG. 15.

Diaphragms 124 and 131 have the same size and structure. Diaphragm 124, shown in FIGS. 15 and 16, has rigid top and bottom plates 136 and 137. The plates 136 and 137 are plastic members reinforced with glass fibers. An expanded polyvinyl chloride core 138 is sandwiched between plates 136 and 137. Core 138 is bonded to the inside surfaces of plates 136 and 137 to connect and reinforce plates 136 and 137. A flexible flange 139 projects outwardly from the outer peripheral edges of plates 136 and 137. Flange 139 is a rectangular flat member of air impervious flexible material, such as rubber, plastic or metal. The inner portion 141 of flange 139 is located between and secured to plates 136 and 137. The outer portion of flange 139 has holes 142 for bolts 126 that secure head plate 121 and flange 139 to wall 114. Flexible flange 139 allows plates 136 and 137 to be laterally moved, as shown as arrows 143, relative to chamber 119 to pulse the air in chamber 119.

Diaphragm 131 has the same structures as diaphragm 124 including rigid plates 144 and 146, foam core 147 and flexible flange 148, shown in FIG. 12. Flexible flange 148 allows plates 144 and 146 to be laterally moved, as shown by arrows 149, relative to chamber 119 to pulse the air in chamber 119.

A motion transmitting mechanism, indicated generally at 151 in FIG. 12, drivably connected to motor 108 converts rotary motion to reciprocating motion to linearly move diaphragms 124 and 131 relative to chamber 119. This causes the air in chamber 119 to pulse by repetitively increasing and decreasing air pressure as diaphragms 124 and 131 are forced into and out of chamber 119. Chamber 119 can be partially filled with solid filler material (not shown) to reduce the clearance volume of chamber 119 and thereby increase the magnitude of the air pulse.

Figure 14:
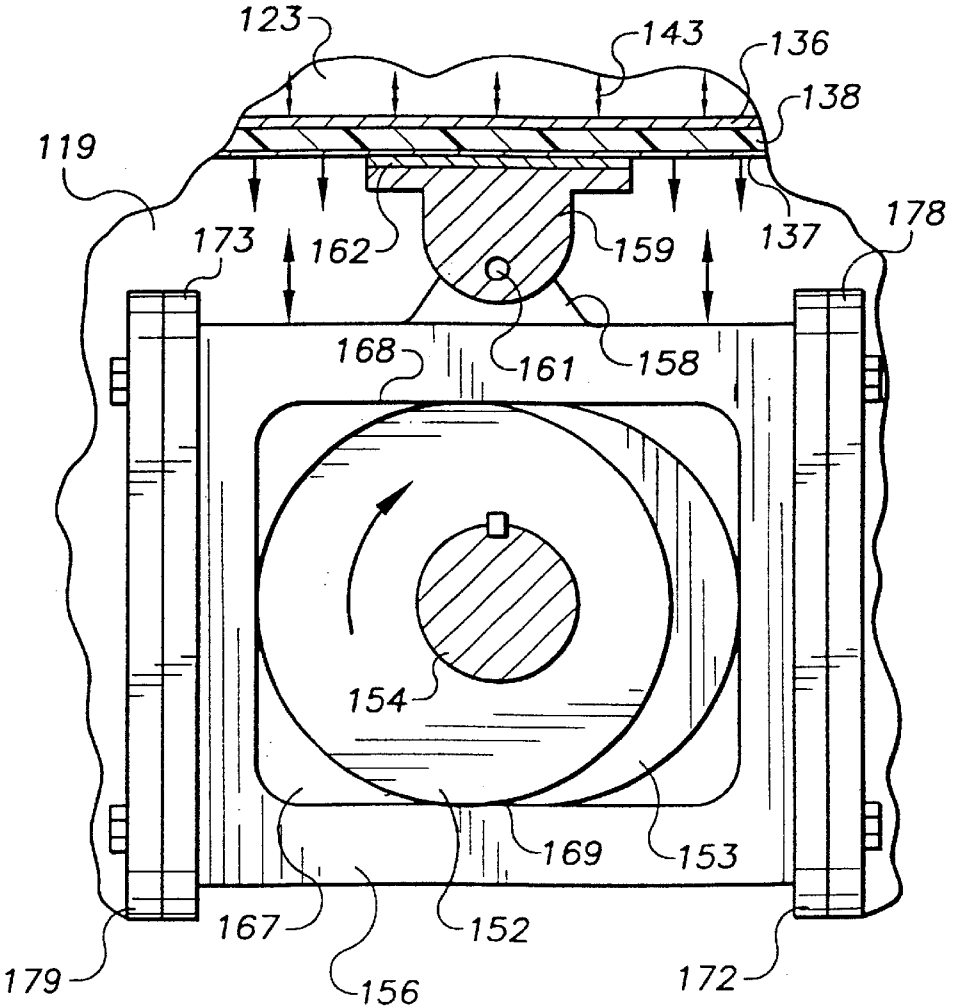
FIG. 14 is an enlarged sectional view taken along the line 14—14 of FIG. 13.
Figure 13:
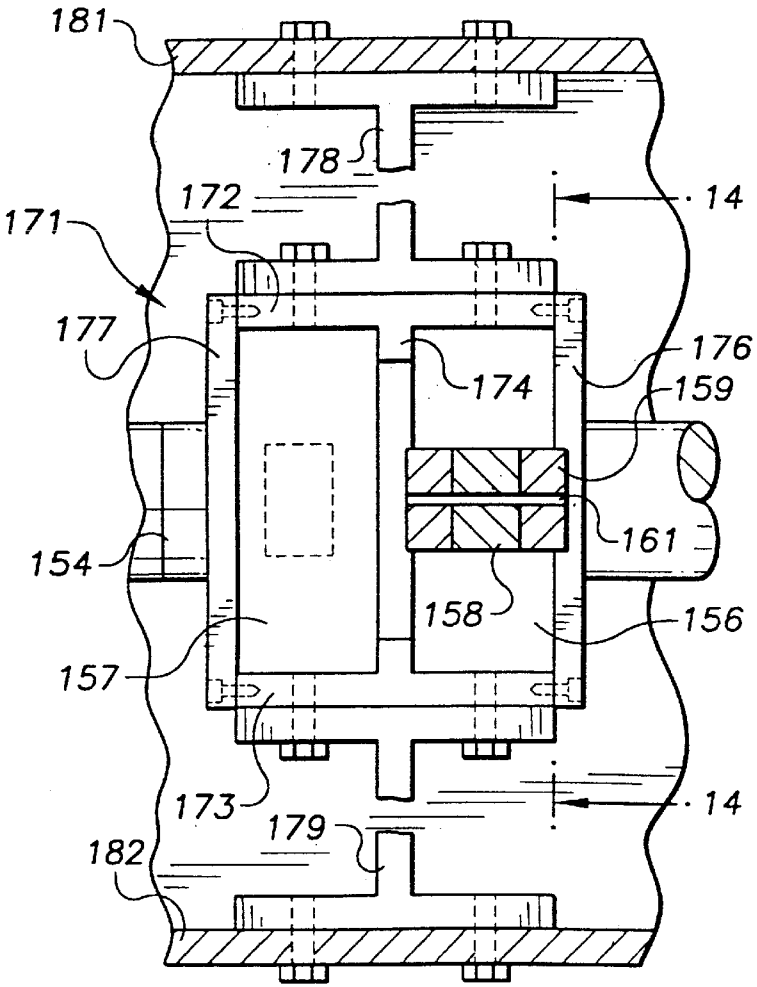
FIG. 13 is an enlarged and foreshortened sectional view taken along the line 13—13 of FIG. 12.

Motion transmitting mechanism 151 has a pair of circular cams 152 and 153 keyed to motor drive shaft 152. As shown in FIGS. 12 and 14, cams 152 and 153 eccentrically mounted on shaft 154 move cam followers 156 and 157 in opposite linear directions. Cams 152 and 153 have 180-degree eccentricity to balance the forces on cam followers 156 and 157 during rotation of shaft 154. An ear 158 joined to cam follower 156 is pivotally connected to a yoke 159 with a pin 161. A layer of adhesive or bonding material 162 secures yoke 159 to the center of diaphragm 124. Cam follower 157 has an ear 163 connected to a yoke 164 with a pin 166. Yoke 164 is secured with an adhesive or bonding material to the center of diaphragm 131. Cam follower 156 has a rectangular opening 167 accommodating cam 152 and upper and lower faces 168 and 169 that contact cam 152. Cam follower 157 has a rectangular opening identical to opening 167 accommodating cam 153 and upper and lower faces that contact cam 153. Motor 108 operates to rotate cams 152 and 153 which move cam followers 156 and 157 in opposite directions thereby moving diaphragms 124 and 131 in opposite linear directions to pulse air in chamber 119.

Cam followers 156 and 157 are located in a casing 171 having linear walls 172 and 173 that have flat guide surfaces engageable with opposite sides of cam followers 156 and 157. Casing 171 has a center rib 174 and end plates 176 and 177 that retain cam followers 156 and 157 in casing 171. Supports 178 and 179 mount casing 171 on walls 181 and 182 of body 111 to fix the location of casing 171 in chamber 119.

In use, jacket 24 is placed about the person's body and retained in place with shoulder straps 36 and 37 connected to releasable members 42 and 48. The circumferential location of jacket is maintained with connected releasable fasteners 44 and 54,56. Air pulsator 29 is connected to vest air input tube 32 with an elongated flexible hose 31.

Figure 9:
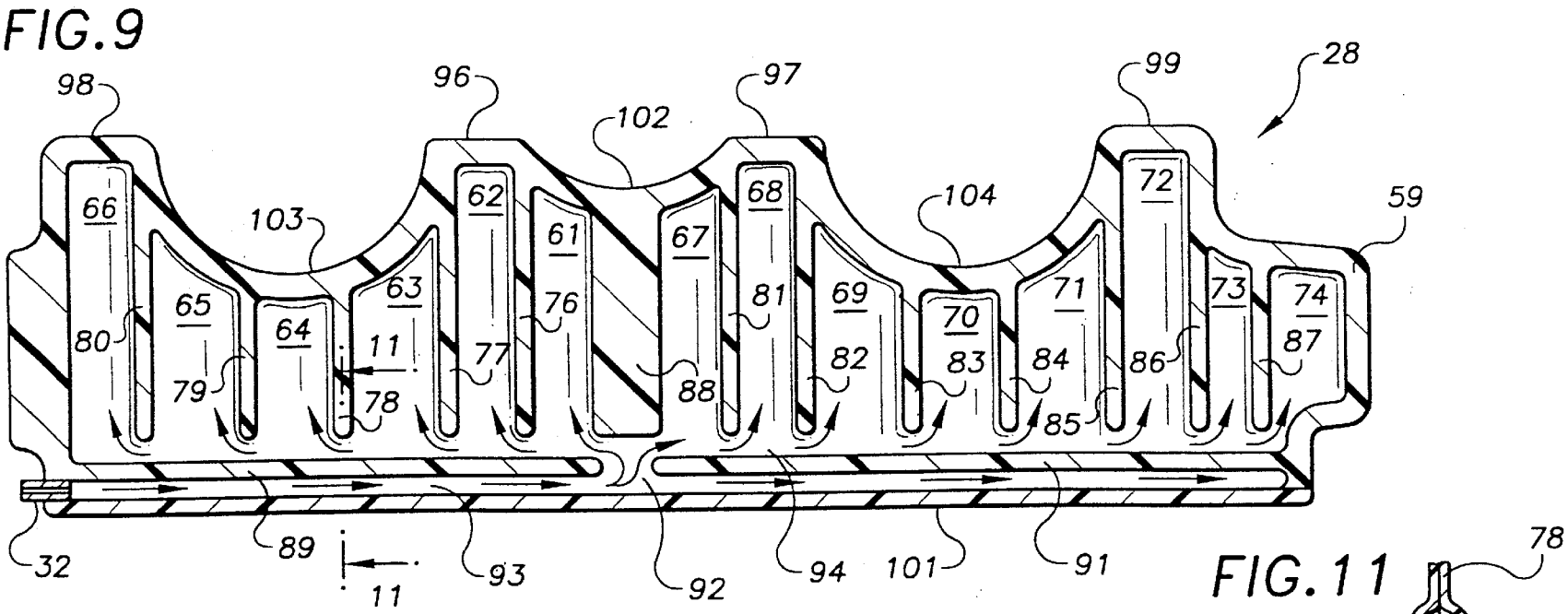
FIG. 9 is a sectional view taken along the line 9—9 of FIG. 8.
Figure 11:
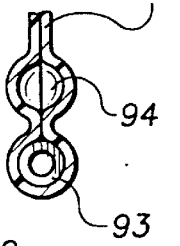
FIG. 11 is a sectional view taken along the line 11—11 of FIG. 9.
Figure 10:
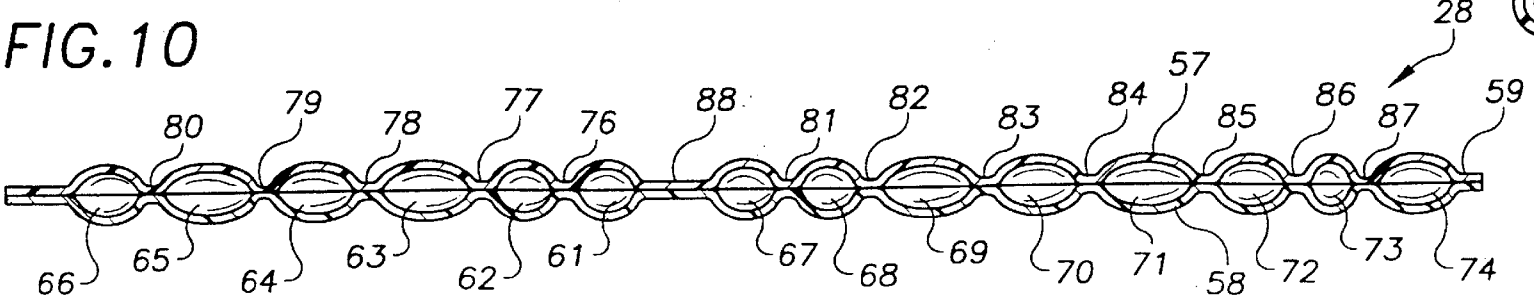
FIG. 10 is a sectional view taken along the line 10—10 of FIG. 7.

The operation of pulsator 29 is commenced to charge the vest and pulsator 29 with air under pressure. The air inflates air core 28. As shown in FIG. 9, the air flows through manifold passage 93, port or opening 92 into upright chambers 61 to 74. The inflated air core 28 holds inside liner 27 in firm engagement with the front, back and sides of the person's body.

Switch 107 is turned ON to start motor 108 which operates the rotary to reciprocating motion transmission mechanism 151 connected to diaphragms 124 and 131. The frequency of the air pulses is adjusted with motor speed control 109 to provide efficient and effective pulses to the person's body. Diaphragms 124 and 131 increase air pressure in chamber 119 to provide an air pulse in jacket 24. When diaphragms 124 and 131 are moved inwardly or toward each other the air pressure in chamber 119 is increased to provide the air pressure pulse in jacket 24. The diaphragms 124 and 131 have rigid plates connected to flexible peripheral flanges which allows linear movements of diaphragms 124 and 131 so that relatively small movements of diaphragms 124 and 131 relative to chamber 119 cause a sufficient change in air pressure in chamber 119. This air pressure change causes repeated pressure pulses in jacket 24. The frequency of the pulses generated in jacket 24 can be altered by changing the speed of motor 108. Control 109 is used to change the speed of motor 108 to alter the frequency of movements of diaphragms 124 and 131 which control the frequency of the air pulses. Also, reducing the clearance volume of chamber 119 can increase the magnitude of the air pressure pulse.

The present disclosure is a preferred embodiment of the body pulsating apparatus and jacket. It is understood that the body pulsating apparatus and jacket are not to be limited to the specific materials, constructions and arrangements shown and described. It is understood that changes in parts, materials, arrangement and locations of structures may be made without departing from the invention.

What is claimed is:

1. A jacket for receiving air pressure and repetitive air pressure pulses from a source of air pressure pulses and applying repetitive pressure pulses to a human body comprising: a non-elastic outer cover, a flexible liner attached to the cover, a flexible air core located between the cover and liner, said air core having an internal chamber adapted to accommodate air pressure pulses which apply pressure pulses to a human body wearing the jacket, a circumferential manifold passage located below the internal chamber, said manifold having an inlet end adapted to receive air pressure and air pressure pulses from a source of air pressure and air pressure pulses, means separating the manifold passage from the internal chamber, said means having at least one opening between the manifold passage and internal chamber to allow air to flow upwardly from the manifold passage into the internal chamber and upwardly pulse the air in the internal chamber, and a connector attached to said air core, said connector having a passage open to the inlet end of the manifold passage for directing air and air pressure pulses from the source of air pressure and air pressure pulses into the manifold passage, said cover having a pair of shoulder straps and chest portions, first releasable means connecting the shoulder straps to the chest portions, first and second end flaps joined to opposite ends of the cover, said end flaps being located in overlapping relation when the cover, liner, and air core are located around the body of the person, and second releasable means connecting the first and second end flaps to hold the liner and air core in contact with the body of the person whereby when the internal chamber of the air core is subjected to air pressure pulses repetitive pressure pulses are transmitted to the body of the person.

2. The jacket of claim 1 wherein: the air core includes flexible sheet members having a plurality of side-by-side upright internal chambers for accommodating air pressure.

3. The jacket of claim 2 wherein: the sheet members at the center of the air core have a middle seal with upright air chambers on opposite sides of the middle seal.

4. The jacket of claim 3 wherein: the at least one opening is located adjacent the middle seal between the manifold passage and upright air chambers.

5. The jacket of claim 1 wherein: the air core includes flexible sheet members having outer peripheral edge portions secured together to enclose the internal chamber, said means separating the manifold passage from the internal chamber comprising adjacent portions of the sheet members secured together to separate the manifold passage from the internal chamber, said adjacent portions having said at least one opening to allow air to flow from the manifold passage into the internal chamber and pulse the air in the internal chamber.

6. A jacket for receiving air pressure and repetitive air pressure pulses from a source of air pressure pulses and applying air pressure and repetitive pressure pulses to a human body comprising: a non-elastic outer cover, a flexible inside liner attached to the cover, a flexible air core located between the cover and liner, said air core having an internal chamber adapted to accommodate air pressure and air pressure pulses which apply air pressure and air pressure pulses to a human body surrounded by the jacket, said air core including flexible sheet members having outer peripheral edge portions secured together to enclose the internal chamber and a circumferential manifold passage located below the internal chamber, said manifold passage having an inlet end adapted to receive air pressure and air pressure pulses from a source of air pressure and air pressure pulses, means separating the manifold passage from the internal chamber, said means having at least one opening between the manifold passage and the internal chamber to allow air to flow upwardly from the manifold passage into the internal chamber and upwardly pulse the air in the internal chamber, said means separating the manifold passage from the internal chamber comprising adjacent portions of the sheet members secured together to separate the manifold passage from the internal chamber said adjacent portions having said at least one opening to allow air to flow from the manifold passage into the internal chamber and pulse the air in the internal chamber and a connector attached to said air core, said connector having a passage open to the inlet end of the manifold passage to allow air and air pressure pulses to flow from the source of air pressure into the manifold passage and through said at least one opening into the internal chamber, and means cooperating with said cover to retain the jacket in a general cylindrical shape around the human body and holding the air core adjacent the human body whereby air pressure and repetitive air pressure pulses subjected to the internal chamber of the air core apply upward repetitive pressure pulses to the human body.

7. A jacket for receiving air pressure and repetitive air pressure pulses from a source of air pressure and air pressure pulses and applying air pressure and repetitive pressure pulses to a human body comprising: a non-elastic outer cover having an inner surface, a first end and a second end, an air core having flexible sheet members surrounding internal upright air chambers for accommodating air pressure, said sheet members at the center of the air core having a middle seal with said upright air chambers on opposite sides of the middle seals a circumferential manifold passage at the lower portion of the sheet members below the upright air chambers, said manifold passage having an inlet end adapted to receive air pressure and air pressure pulses from a source of air pressure and air pressure pulses, means separating the manifold passage from the upright air chambers, said means having at least one opening allowing air to flow upwardly from the manifold passage into the upright air chambers and upwardly pulse the air in the upright air chambers, and a connector attached to said sheet members having a passage open to the inlet end of the manifold passage for directing air from the source of air pressure into the manifold passage, means for holding the air core in general surface engagement with the inner surface of the cover, and releasable means on the first and second ends of the cover for selectively coupling the first and second ends forming the cover in a generally cylindrical shape and holding the air core adjacent the human body whereby repetitive air pressure and air pressure pulses subjected to the internal chamber of the air core apply air pressure and repetitive pressure pulses to the human body.

8. The jacket of claim 7 wherein: the flexible sheet members surround a plurality of upright internal chambers for accommodating air pressure.

9. The jacket of claim 7 wherein: the at least one opening is located adjacent the middle seal between the manifold passage and upright air chambers.

10. A jacket for receiving air pressure and repetitive air pressure pulses from a source of air pressure and air pressure pulses and applying air pressure and repetitive pressure pulses to a human body comprising a non-elastic outer cover having an inner surface a first end and a second end an air core having flexible sheet members having outer peripheral edge portions secured together surrounding an internal chamber to enclose the internal chamber for accommodating air pressure a circumferential manifold passage at the lower portion of the sheet members below the internal chamber, said manifold passage having an inlet end adapted to receive air pressure and air pressure pulses from a source of air pressure and air pressure pulses means separating the manifold passage from the interior chamber said means having at least one opening allowing air to flow upwardly from the manifold passage into the internal chamber and upwardly pulse the air in the internal chamber, said means separating the manifold passage from the internal chamber comprising adjacent portions of the sheet members secured together to separate the manifold passage from the internal chamber, said adjacent portions having said at least one opening to allow air to flow from the manifold passage into the internal chamber and pulse the air in the internal chamber, and a connector attached to said sheet members having a passage open to the inlet end of the manifold passage for directing air from the source of air pressure into the manifold passage, means for holding the air core in general surface engagement with the inner surface of the cover and releasable means on the first and second ends of the cover for selectively coupling the first and second ends forming the cover in a generally cylindrical shape and holding the air core adjacent the human body whereby repetitive air pressure and air pressure pulses subjected to the internal chamber of the air core apply air pressure and repetitive pressure pulses to the human body.

11. The jacket of claim 7 wherein: the cover includes a pair of shoulder straps and chest portions, and releasable means connecting the shoulder straps to the chest portions to support the jacket on the shoulders of the human body.

* * * * *